United States Patent [19]

Rokicki et al.

[11] 4,384,429

[45] May 24, 1983

[54] MOVEABLE, ROLLAWAY DOOR STRUCTURE

[75] Inventors: Stanley A. Rokicki; Mirek A. Przybylski, both of Toronto, Canada

[73] Assignee: Inline Limited, Mississauga, Canada

[21] Appl. No.: 256,830

[22] Filed: Apr. 29, 1981

[30] Foreign Application Priority Data

Apr. 2, 1981 [CA] Canada ..... 374515

[51] Int. Cl.[3] ..... E05D 15/20

[52] U.S. Cl. ..... 49/130; 49/219; 49/DIG. 1; 52/207

[58] Field of Search ..... 49/219, 220, 221, 127, 49/128-130, DIG.1; 52/207

[56] References Cited

U.S. PATENT DOCUMENTS

| | | | |
|---|---|---|---|
| 1,815,607 | 7/1931 | Beers | 49/130 |
| 2,145,403 | 1/1939 | Nemec | 49/225 |
| 2,532,491 | 12/1950 | Frueh | 49/219 |
| 2,680,268 | 6/1954 | Rutherford | 49/130 |
| 2,764,784 | 10/1956 | McCall | 49/130 |
| 2,790,211 | 4/1957 | Ebbert et al. | 49/219 |
| 2,819,498 | 1/1958 | Grossman | 49/130 |
| 3,293,801 | 12/1966 | Henning | 49/130 |
| 3,841,024 | 10/1974 | Cheng | 49/130 |
| 3,908,313 | 9/1975 | Bierlich | 49/DIG. 1 X |
| 4,317,312 | 3/1982 | Heideman | 49/220 |

FOREIGN PATENT DOCUMENTS

| | | | |
|---|---|---|---|
| 466466 | 5/1937 | United Kingdom | 49/130 |

*Primary Examiner*—Philip C. Kannan
*Attorney, Agent, or Firm*—Donald E. Hewson

[57] ABSTRACT

A moveable, rollaway door or window panel is provided in a structure having one moveable panel and one fixed panel. The moveable panel, when in its closed position, is substantially co-planar with the fixed panel; and when in its fully open position, it is substantially co-extensive with and on the interior side of the fixed panel. A pair of control rods, one at each side, is concealed within the sash structure of the moveable panel, and is secured at its top and bottom ends to a cam member. Each cam member has a guide member which co-operates with a guide track, and is rotatable with respect thereto. The cam members at the upper ends of the control rod are connected to each other by a tie rod or cable in such a way that rotation of one of the control rods causes an equal rotation in the same direction of rotation of the other of the control rods, thereby assuring planar movement of all four corners of the moveable panel. The structure therefore combines features of both sliding and casement window or door installations.

10 Claims, 10 Drawing Figures

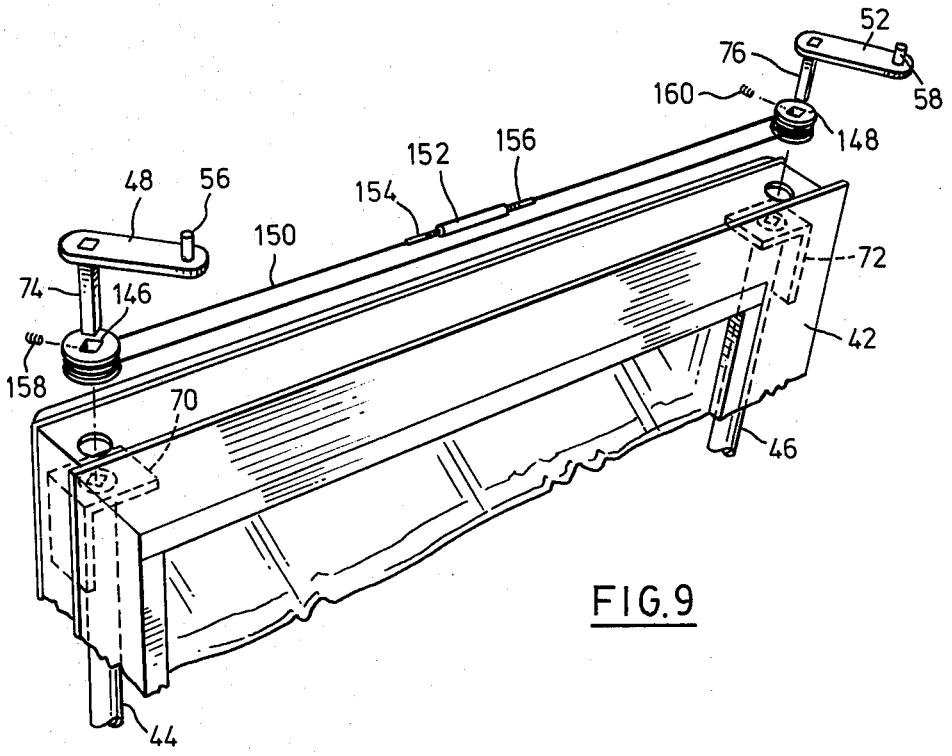
FIG.9
FIG.10
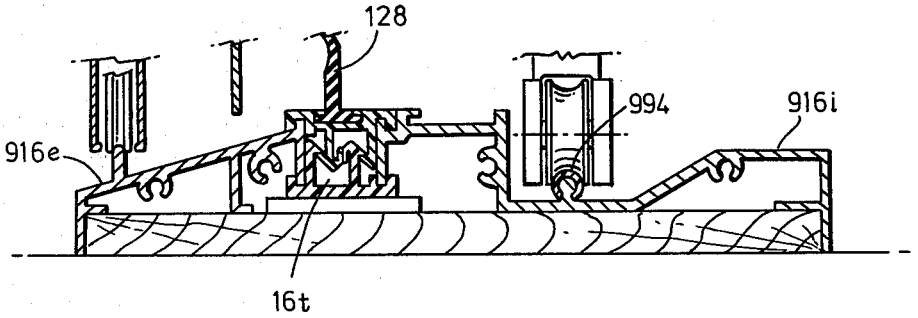

MOVEABLE, ROLLAWAY DOOR STRUCTURE

FIELD OF THE INVENTION

This invention relates to moveable, rollaway door and window panels, particularly door and window panels of considerable size such as patio doors, having one moveable, sliding panel. More specifically, this invention relates to door and window structures which are principally intended for use in the exterior walls of building structures such as residential and light commercial buildings.

BACKGROUND OF THE INVENTION

Sliding panels, particularly panels for such use as patio doors, or windows, are well known in the construction industry. Most sliding patio doors, for example, comprise a structure having two panels, one of which is fixed and the other of which is the moveable or operating panel. Each of the two panels is mounted on a separate track, in such a manner that the moveable or operating panel is mounted so as to move on the interior side of the fixed panel. Because the moveable panel is mounted in a separate track, sufficient clearance must be made between the panels, particularly at the place where the side sash members of the panels overlap. A number of difficulties and problems arise from such structures, particularly having to do with rendering the structure weathertight, and providing satisfactory thermal performance with respect to heat loss through air infiltration or exfiltration past and around the sliding door structure.

Other sliding door structures are known for such purposes as closets or cabinets, where it is desired to disguise moveable panels, or to provide a structure whereby two sliding doors can be arranged for movement, one with respect to the other, having a single suspension or guide track.

In the latter instances, the prior art provides several examples of structures where two panels are substantially co-planar or in line with each other, when they are both in their closed positions.

For example, GROSSMAN U.S. Pat. No. 2,819,498, issued Jan. 14, 1958, shows a sliding door arrangement with a switching system whereby one door can be moved rearwardly with respect to the other door, and then moved in a track behind the other door so as to bypass it.

Another example is shown in CHENG, U.S. Pat. No. 3,841,024, issued Oct. 15, 1974, where a sliding window arrangement is shown having a fixed and a sliding window, where the sliding window panel is pushed rearwardly then slid open on it's own track.

HENNING, in U.S. Pat. No. 3,293,801, issued Dec. 27, 1966, shows an apparatus for mounting sliding doors in a cabinet, where the door to be moved is pulled into a position outward from the other door, having an articulation in respect of the mounting means such that the door to be moved is suspended or supported from a door carriage in one of two positions which are displaced horizontally inwardly or outwardly with respect to the plane of movement of the door.

Likewise, RUTHERFORD, in U.S. Pat. No. 2,680,268, issued June 8, 1954, discloses a moveable panel structure whereby either of two panels which are intended for closures for closets and the like may be moved sideways by first displacing one of the panels forwardly with respect to the other and thence accommodating a sideways movement of either on its own independent track. In the case of RUTHERFORD, one panel which is displacable inwardly and outwardly with respect to the closure plane is supported at its sides by a pair of spaced vertical rods to which the panel is hingedly connected. Thus, the rods are rotatable with respect to fixed guides, and the panel is moveable inwardly and outwardly with respect to the plane in which the rods are always maintained, which plane lies behind the plane in which the panels are located when they are both closed.

A structure such as that particularly described by RUTHERFORD is, however, of little value where it is intended that it should be placed in a window or door opening in the exterior wall of a building, such as a home, office or factory. This is particularly because there is no structure nor any contemplation of any means by which the panels can be sealed against weather, and so as to substantially preclude air infiltration or exfiltration.

In the standard sliding window or door structure of the usual sort, particularly sliding patio doors, the sash frames of the panels and the outer frames within which the structure is fitted are now usually formed of extruded aluminum. Weather stripping, door sweeps and the like are provided, formed of such materials as a loose fibrous polypropylene pile, or of flexible vinyl or neoprene, for example. However, where one panel such as a patio door is mounted in its own track so as to clear the other panel—so that, when opened, substantially one half of the entire wall opening filled by the window or door structure is open for passage therethrough—some particular problems with respect to weather and air leakage exist. Moreover, because aluminum is, itself, a good thermal conductor, it is important to provide a structure having a thermal break formed therein, so as to avoid conduction losses of heat.

Recently, considerable attention has been given to means and structures whereby energy losses can be minimized. The present invention assists such aims and objectives, by providing a door or window structure where one panel is fixed and the other is moveable, such as in a patio door structure, and which overcomes problems of the prior art in respect of its seal against weather and its thermal performance against heat loss.

Moreover, the present invention provides a structure by which large moveable panels of the sort used for patio doors, may be easily moved, and easily re-positioned from a fully closed to a fully open position.

Still further, the present invention provides a structure which may be substantially tamper-proof, thereby providing security against unwanted intrusion.

What the present invention provides therefor, is a structure which has the storage or in-line features of a caseme window or door installation; together with the out-of-plane sliding features of a sliding door or window installlation.

Three principal embodiments of the present invention are discussed in greater detail hereafter. In the first embodiment, a rack and pinion driving connection is made between two control rods within the sash structure of the moveable panel; in the second embodiment, a direct driving connection is made between the control rods; and in the third embodiment, a direct driving, fixed cable connection is made between the control rods.

Of more importance, however, is the fact that the present invention provides a structure which minimizes heat loss as well as inside surface condensation in a door or window installation, where all of the sealing members or gaskets are readily available for inspection and replacement if necessary, and by which the sealing gaskets are totally unhindered by mounting hardware or the like.

According to standards presently in force in Canada, having to do with residential sliding doors and windows, air infiltration allowed for a sliding door or window unit must not exceed 0.75 cu.ft./min./sq.ft. of overall frame size. Air infiltration of the non-operating or fixed panel must not exceed 0.06 cu.ft./min./sq.ft. of overall frame size; i.e., approximately 8% of that permitted for the sliding unit.

The present invention is intended to provide far better air infiltration performance than that minimally required by such as the National Building Code of Canada, and does so by providing for a horizontally sliding structure which is supported at its four corners, and moves as a unit by pivoting around the support points at the four corners from a closed to a sliding position or vice versa—i.e., forwards or backwards with respect to the plane in which the panel is either in its closed position or its sliding position.

To effect the above objects, the present invention provides a door or window structure intended to be fitted in door or window openings in exterior walls of buildings, which structure has an outer frame, and first and second panels which are each approximately of equal size to each other. The first panel is substantially fixed in place and the second panel is moveable from a first, closed, position to a second, fully open, position; such that when the second panel is in the first position, it is substantially co-planar with the first panel, and when the second panel is in the second position, it is substantially co-extensive within the outer frame with the first panel, and on the interior side of the window structure. At least the second panel has a sash frame, having within it and at each side thereof a substantially rigid control rod, where each control rod is rotatably mounted within the sash frame and is securely connected at its top and bottom ends with a cam member. Each of the cam members has a guide member secured to it for engagement with a co-operating guide track, and each guide member is rotatable with respect to its co-operating guide track. A fixed tie means, which may be a tie rod or a fixed cable, is placed between the control rods, so that rotation of one of the control rods causes an equal rotation in the same direction of rotation of the other of the control rods. At the exterior side of the second panel when it is in its closed position, there is an opening in the frame, which opening is of lesser size than the second panel. A first compressible gasket surrounds the opening at the interior side thereof, and is placed so as to contact a co-operating portion of the exterior surface of a second panel so that when it is in its closed position, the gasket is at least partially compressed. A second gasket is also placed within the outer frame at the interior side thereof, in such a place as to contact a second co-operating portion of the exterior surface of the second panel when the panel is closed, so that the second gasket is flexed, and a substantially isolated pocket is formed within the outer frame between the first and second gaskets, substantially around the periphery of the exterior surface of the second panel. The isolated pocket serves to equalize air pressure between the interior and exterior sides of the door or window structure.

As will be described in greater detail hereinafter, there are several alternative embodiments as to the linkage arrangement between the control rods and the tie rod, and as to the co-operation of the guide members—particularly the lower guide members—with the respective guide track.

BRIEF DESCRIPTION OF THE DRAWINGS

The present invention, in alternative embodiments, is described in greater detail hereafter, in association with the accompanying drawings, in which:

FIG. 9 is a view similar to FIGS. 2 and 6, showing a third embodiment of the upper portion of the moveable panel; and FIG. 10 is a partial cross-section showing an alternative embodiment of the lower frame member shown in FIG. 5.

DESCRIPTION OF THE PREFERRED EMBODIMENTS

Figure 1:
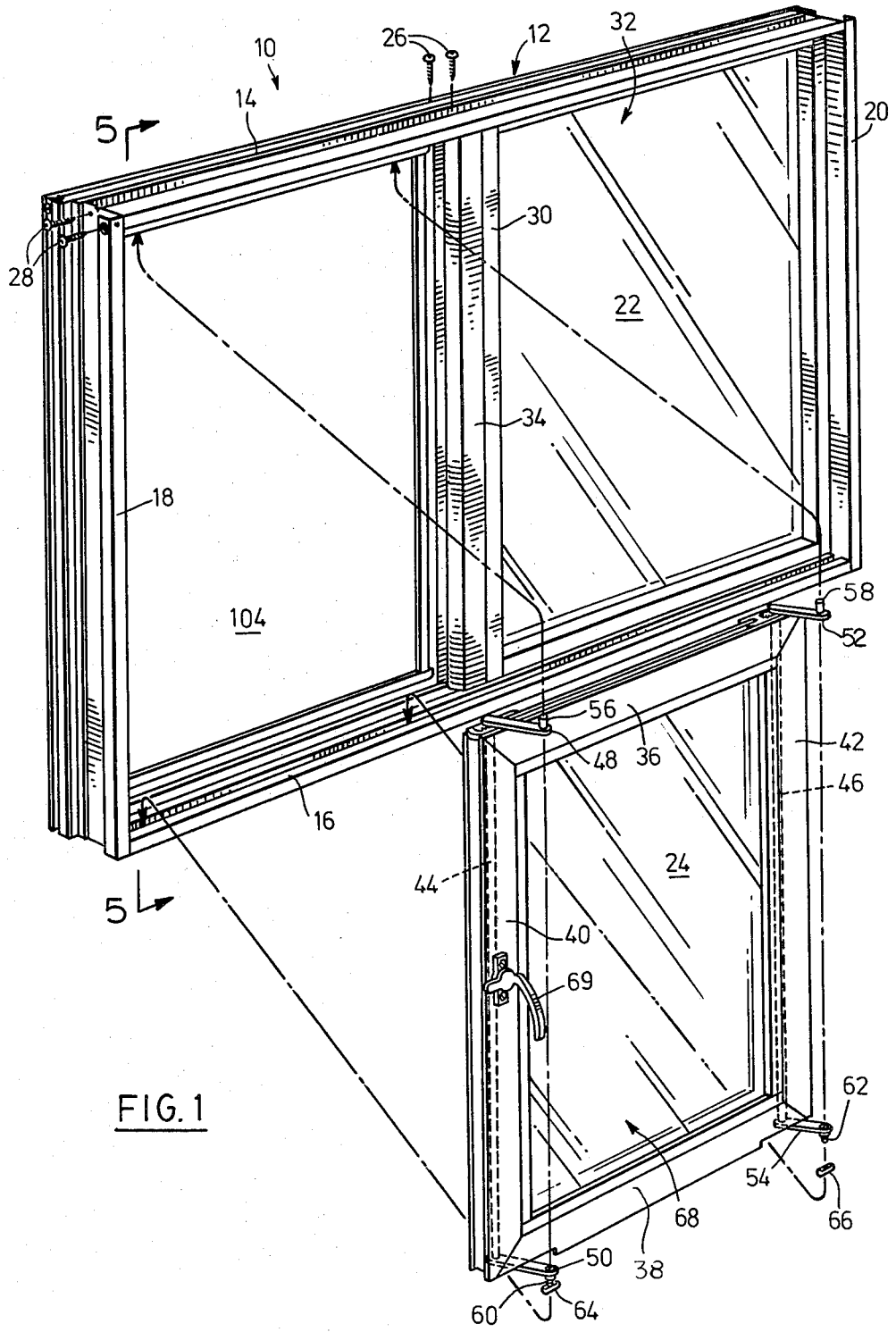
FIG. 1 is an exploded, perspective view of a window or door structure according to the present invention, showing the general assembly of the principal components thereof.

As mentioned, the present invention provides a door or window structure 10 which is intended to fit into door or window openings in the exterior walls of buildings, and in particular such buildings as residential or light commercial construction. The invention is particularly adapted for patio doors, and for window structures where one of the two panels is intended for sideways—i.e., horizontal—sliding motion between its open and its closed positions. The structure includes an outer frame designated generally at 12, comprising top and bottom members 14 and 16 and side members 18 and 20, respectively. As will be discussed in greater detail hereafter, each of the top, bottom and side members comprises a plurality of members, with inner and outer rails and a thermal break member between them.

Within the frame 12, there are located two panels, a first panel 22 and a second panel 24. The first panel is substantially fixed in place, and the second panel 24 is moveable from a first, closed position to a second, fully open position, and any intermediate position. Either panel 22 or 24 may be the left or right hand panel in the closed position, depending upon requirements of the specific installation.

In general, the door or window structure according to the present invention is assembled from structural members which are extruded aluminum and plastics, depending on which member and its purpose. The entire frame assembly is conveniently assembled by screws appropriately placed, such as screws 26 and 28 shown in FIG. 1.

The first panel 22 comprises a frame 30, within which a glass or more generally a dual, hermetically sealed glass structure, 32, is placed. A mullion 34 is secured between the upper and lower members 14 and 16 at the inner edge of the fixed panel 22.

The second, moveable, panel 24 has a sash frame with upper and lower frame members 36 and 38 and side members 40 and 42. Within the sash frame there are located two substantially rigid control rods, 44 and 46, respectively, one at each side; and securely connected to the top and bottom ends of the control rods 44 and 46 are cam members 48, 50, 52 and 54. Each of the cam members has a guide member secured to it, indicated at 56, 58, 60 and 62. The bottom guide members 60 and 62 have slider blocks (in the embodiment shown) indicated at 64 and 66, respectively.

A handle 69 is secured to one of the members of the sash frame of the panel 24, and is rotatable and lockable in an appropriate co-operating locking recess in the outer frame 12 of the structure 10.

As in the panel 22, a glass or dual, hermetically sealed glass structure 68, is placed in the panel 24.

Figure 2:
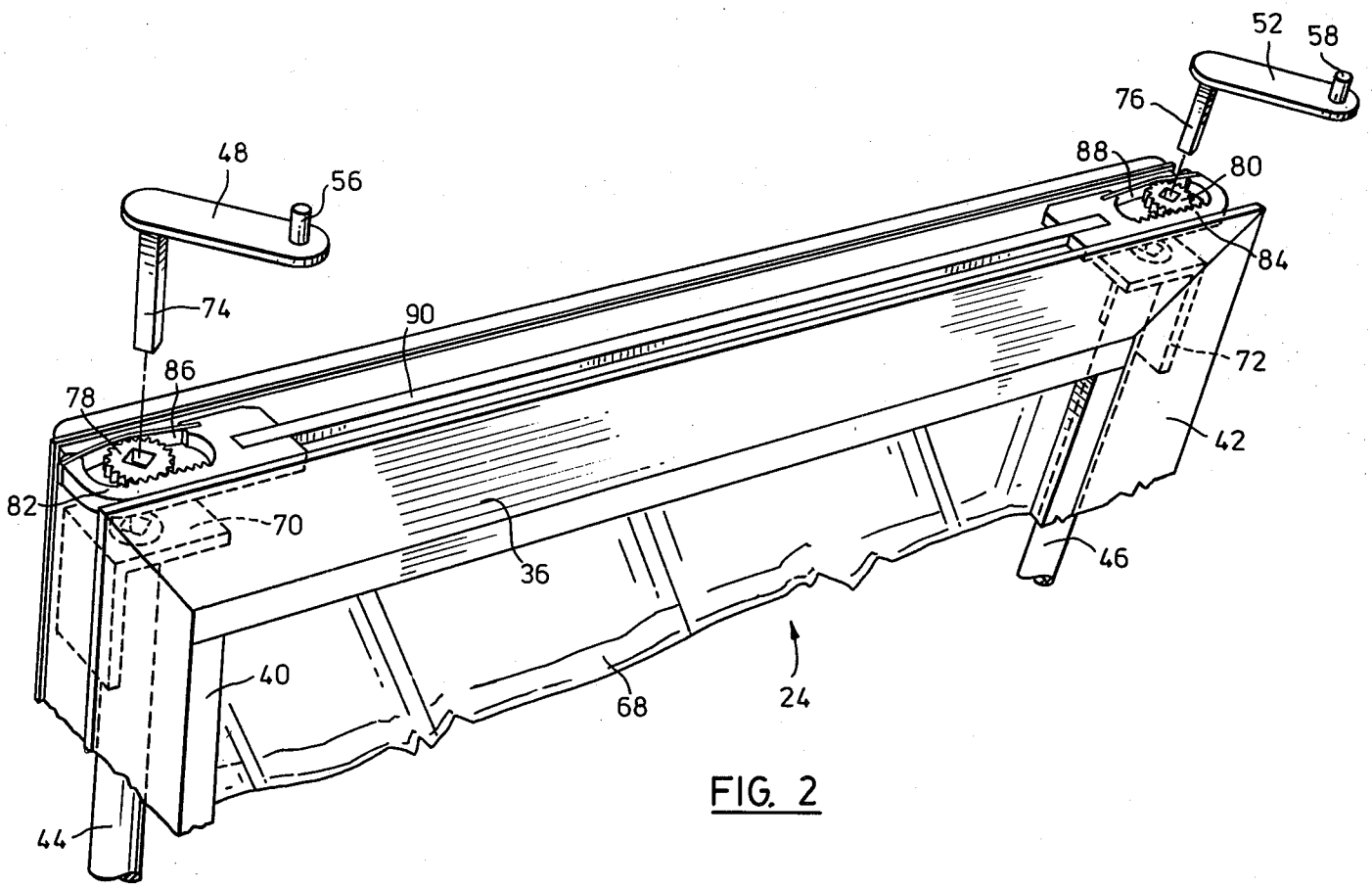
FIG. 2 is a partial perspective and exploded view, showing a first embodiment of the upper portion of the moveable panel.

Turning to FIG. 2, certain details of the operating structure of the first embodiment of panel 24 are shown. Within the sash structure there are located two corner angle members 70 and 72 at the upper part thereof, and a similar pair (not shown) is at the bottom of the sash structure. The corner angles are secured in place, and serve to position the upper and lower ends of the control rods 44 and 46, so that the control rods are secured in place but are rotatable. Conveniently, the control rods are extruded aluminum having a central bore of square cross-section, so that the cam members (48 and 52 are shown) may be securely connected to the control rods 44 and 46 by inserting the stems 74 and 76 into the correspondingly shaped hollow core of the respective control rods 44 and 46.

In the embodiment of FIG. 2 (and FIGS. 3 and 4) the stems 74 and 76 each pass through and co-operate with gear members 78 and 80. Gears 78 and 80 are, in turn, meshed with rack members 82 and 84; and the gears 78 and 80 are secured in meshing co-operation by leaf spring members 86 and 88. Connected between the rack members 82 and 84 is a tie rod element 90, which is substantially rigid and secured to the rack elements 82 and 84 and thence by rack and pinion driving arrangements to the control rods 44 and 46. Obviously, rotation of one of the control rods 44 or 46 causes an equal rotation in the same direction of rotation of the other control rod.

Figure 5:
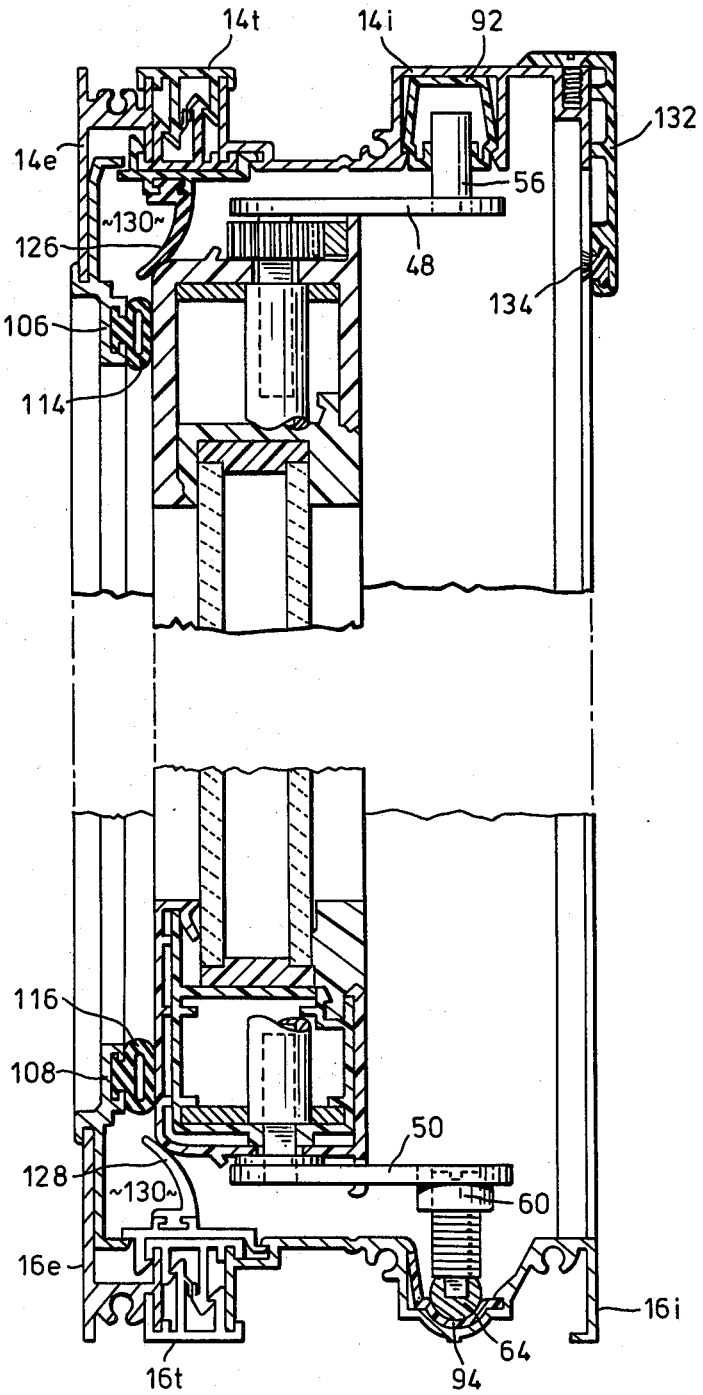
FIG. 5 is a cross-section taken in the direction of arrows 5—5 of FIG. 1, with the second panel in its closed position.

Again referring to FIG. 1, it is noted that the guide members 56 and 58 are intended to fit into a co-operating track (indicated at 92 in FIG. 5); and likewise, the guide members 60 and 62 together with their respective sliding elements 64 and 66 fit into a co-operating track member (one embodiment of which is shown at 94 in FIG. 5). In any event, it is seen that the physical co-operation between the frame 12 and the panel 24, so as to maintain the frame 24 in place, comes as a consequence of the co-operation of the guide members with their respective co-operating guide tracks.

Figure 3:
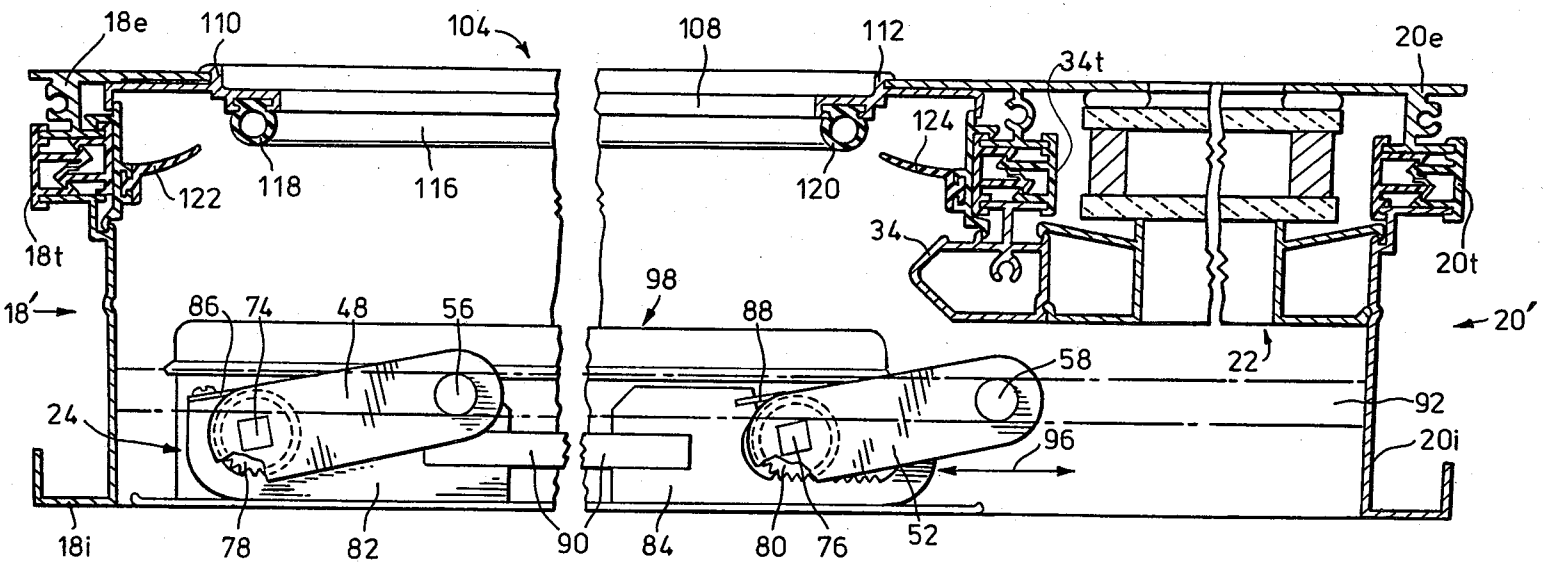
FIG. 3 is a cross-section—broken in length—taken at the top of the panels, with the second panel in position for sideways sliding motion.

As seen in FIG. 3, the panel member 24 is slidable with the guides 56 and 58 in co-operating track 92 (and similarly with the lower guides secured in their co-operating track). The panel 24 is shown in FIG. 3 to be in a plane which is inwards of the plane of panel 22, to the extent that the panel 24 may be slid horizontally, as indicated by double-headed arrow 96. The exterior surface 98 of the panel 24 clears the interior surface of the panel 22; so that, when the panel 24 is in its fully open position, it is physically located and is substantially co-extensive with panel 22 in the same plane where it is shown in FIG. 3.

Figure 4:
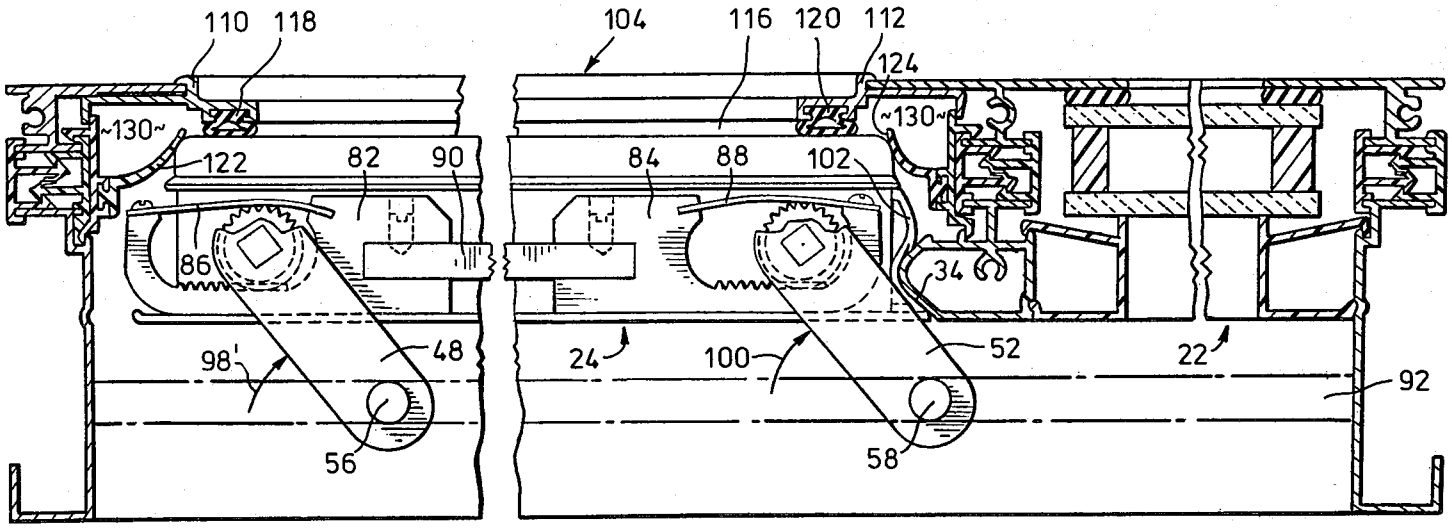
FIG. 4 is a view similar to FIG. 3 with the second panel in its closed position.

However, as shown in FIG. 4, when the panel 24 is in its closed position, it is in a position which is substantially co-planar with panel 22. In this case, it will be seen that the guide members 56 and 58 remain in the track 92, but the cam members 48 and 52 have rotated (counter clockwise in the present circumstances) as indicated by arrows 98' and 100. The rack members 82 and 84 and the tie rod 90 have assumed different positions than that shown in FIG. 3, which has been accommodated by the rotation of the control rods 44 and 46 within the sash frame of the panel 24.

Clearly, in order for the panel 24 to have moved from the position of FIG. 3 to that of FIG. 4, it has been merely necessary to push forwardly on it, thereby causing a rotative action of the guide members and their respective cam members, and as well causing rotation of the control rods to which the cam members are secured. In the embodiment illustrated, the forward planar motion of the panel 24 is accompanied by a slight motion to the left and thence to the right, so as to secure a firm engagement of a sash frame member 102 at the right end of the panel 24 with the mullion 34. By such arrangement, the engagement of the panel 24 with mullion 34 and panel 22 is substantially tamper-proof, when the handle 69 is locked in its co-operating locking recess in outer frame 12. The cams 48, 50, 52 and 54 are at an angle to the plane of moveable panel 54, so that they resist any inwardly directed push or pull against the panel, perpendicularly thereto. This also provides security against any unwanted movement of the panel 24.

In summary, so far, it has been shown that the panel 24 may be moved from a plane where it is in a fully closed position as illustrated in FIG. 4 to a plane where it is capable of being moved sideways, as shown in FIG. 3; and the movement of the panel 24 from the one plane to the other plane is accommodated by the rotative action of the controls rods 44 and 46 which are within the sash frame of the panel 24, and which are secured at their upper and lower ends to cam members which, in turn, are rotatively mounted so as to permit a swinging action of the cam members about the guide member, carrying with them the four corners of the panel 24. By having the four corners of the panel 24 secured in such a manner within the frame that they all move in concert with one another because of the driving connection between the control rods through the cam members and the tie rod across the top of the panel, movement of the entire panel without distorting the relative positions of any of the corners to one another, is assured.

Referring now to certain details of the assembly of the window or door structure, it has been stated above that each of the frame members 14, 16, 18 and 20 in fact comprises interior and exterior members with a thermal break member between them. These members are detailed in FIGS. 3, 4 and 5. However, the specific profile of each member is not discussed, except as necessary hereafter for an understanding of the present invention.

In FIGS. 3 and 4, the side rails 18 and 20 of the outer frame of the structure according to the present invention are shown. Each side rail comprises a first aluminum extrusion (in this case) at the exterior of the structure, designated 18*e* and 20*e* and an interior extrusion designated 18*i* and 20*i*, and between them at each side is an extruded vinyl thermal break member 18*t* and 20*t*, respectively. Likewise, as indicated in FIG. 5, the upper member 14 comprises exterior, interior and thermal break members 14*e*, 14*i* and 14*t* respectively; and the lower frame member comprises members 16*e*, 16*i* and 16*t*. The thermal break member has the same cross-section in all instances.

It will be noted that the interior members 14*i* and 16*i* at the upper and lower extremities of the frame accommodate runners or tracks 92 and 94, as discussed above.

It will also be noted that, in the embodiment illustrated in FIG. 5, the lower guide member 60 is threadably engaged with the lower cam member 50. This is so as to accommodate differences in height of the overall structure, as required by installation codes for such building components as patio doors.

FIGS. 3, 4 and 5 also show another important feature of the present invention. It will be noted, in FIG. 1, that an opening 104 exists within the door or window structure 10, in the place which would normally be covered by the sliding panel 24 when it is in its closed position as indicated in FIG. 4. Around the opening 104 is a frame, having upper and lower members 106 and 108, and side members 110 and 112, respectively. Secured to each of the frame members 106, 108, 110 and 112 are gasket members 114, 116, 118 and 120, respectively, which are conveniently secured to the frame members by being keyed thereto. The gaskets are formed of a flexible material such as flexible vinyl or neoprene, and are compressible by virtue of having a hollow interior. As indicated in FIG. 3, when sliding panel 24 is in its open position, the compressible gaskets maintain their substantially round cross-section—or such other cross-section as may be convenient and useful. However, when the moveable panel 24 is in its closed position, as shown in FIGS. 4 and 5, the compressible gaskets are at least partially compressed, as indicated.

Likewise, there are secured around the opening 104 a second series of flexible gaskets. They are conveniently keyed to the thermal breaks 18*t*, 34*t* (at the exterior of the mullion 34) 14*t* and 16*t*, and are indicated at 122, 124, 126 and 128, respectively. When the moveable panel 24 is in its open position, the flexible gaskets assume the position indicated in FIG. 3. However, when the moveable panel is in its closed position, they are flexed to the position shown in FIGS. 4 and 5. Obviously, each of the compressible gaskets 114, 116, 118 and 120 and the flexible gaskets 122, 124, 126 and 128 co-operate with respective portions of the exterior surface of the moveable panel 24, and particularly its sash frame, so as to cause the compressing and flexing of the gaskets.

By allowing for the compressibility of the gaskets 114, 116, 118 and 120 and the flexibility of the gaskets 122, 124, 126 and 128 when the panel 24 is in its closed position, there is created substantially around the periphery of the exterior surface of the panel 24 a substantially pressure equalized and water drainable pocket designated at 130 in FIGS. 4 and 5. The substantially pressure equalized pocket 130 is formed within the outer frame 12 between the compressible gaskets 114, 116, 118 and 120 and the flexible gaskets 122, 124, 126 and 128.

The compressible gaskets 114, 116, 118 and 120 function as primary weather seals, to preclude the intrusion of rain and precipitation, dust, etc.; and the flexible gaskets 122, 124, 126 and 128 function as air seals so as to effectively preclude air infiltration or exfiltration around the moveable and slideable panel 24.

Figure 6:
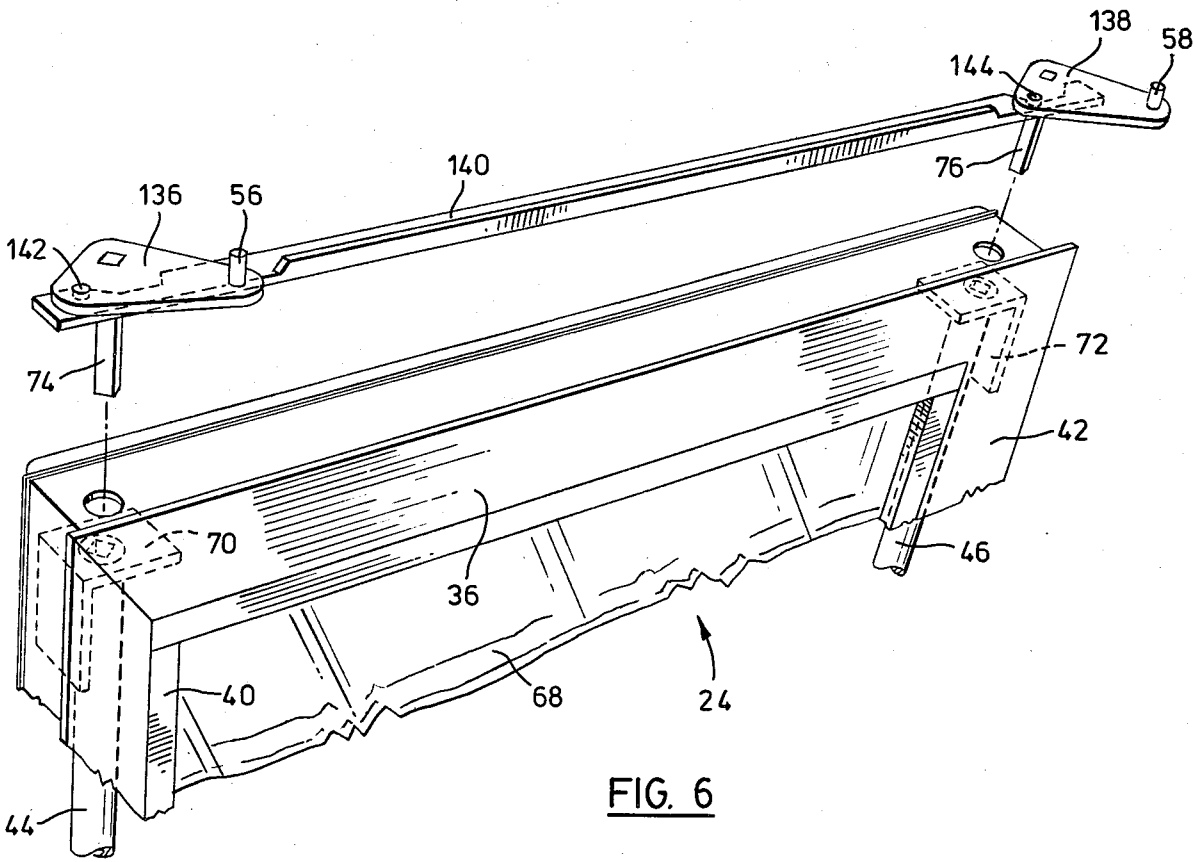
FIG. 6 is a view similar to FIG. 2, showing a second embodiment of the upper portion of the moveable panel.
Figure 7:
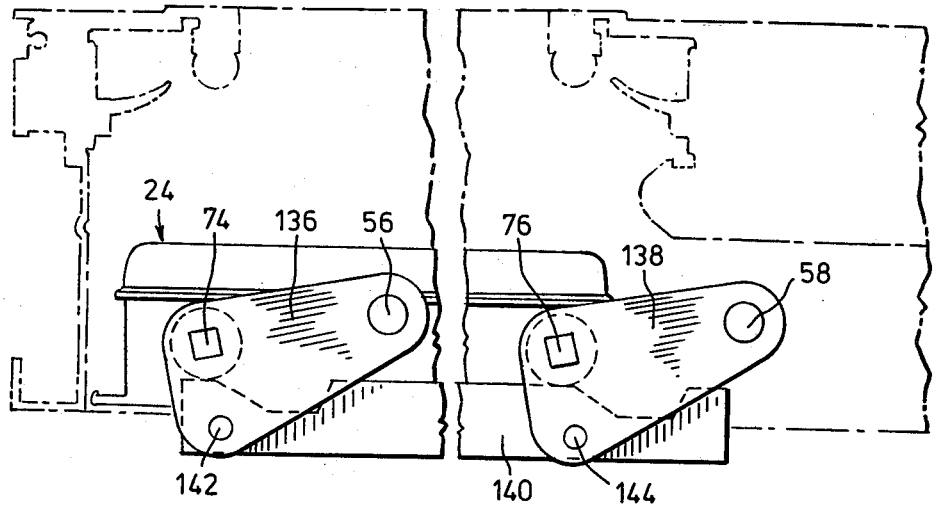
FIGS. 7 and 8 are views similar to FIGS. 3 and 4 except showing only the relative working components of the second embodiment of FIG. 6 in the open and closed positions, respectively.
Figure 8:
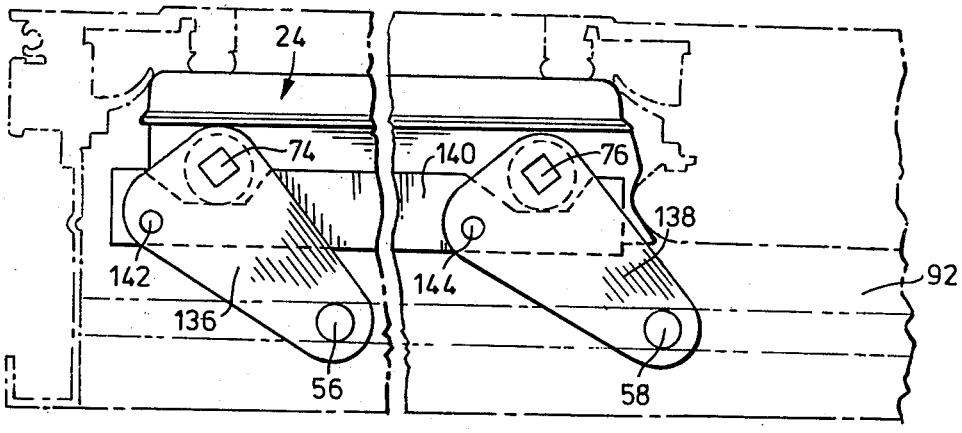

Also shown in FIG. 5 is an extruded aluminum valence 132, which has a synthetic plastics bumper 134 keyed to it, and which is secured to the top interior frame member 14*i*. The valence member 132 functions together with the bumper 134 to preclude excessive outer motion of the panel 24 while it is moving outwards due to rotating action of the guide means in their respective tracks. Referring now to FIGS. 6, 7 and 8, a further, heavy duty, embodiment of the control rod and tie rod operating mechanism, and their relationship to the cam members, is shown. Only the relevant members have been indicated in those Figures, for ease of reference, and like elements retain the same designation as in the embodiment of FIGS. 1 through 5.

Thus, the principal differences between the embodiments of FIGS. 2 and 6 are the replacement of cam elements 48 and 52 by cam elements 136 and 138, respectively, and the replacement of tie rod 90 by tie rod 140.

It will be noted that the cam element 136 is secured to control rod 44 in the manner discussed above, and likewise cam element 138 is secured to control rod 46 in the same manner. Guide members 56 and 58 co-operate with a track, in the same manner as before. However, it will be noted that in this embodiment, the cam elements 136 and 138 are each rotatably mounted directly to the tie rod 140 at pins 142 and 144. Thus, as is best illustrated in FIGS. 7 and 8, motion of the moveable panel 24 from the open to the closed position, or vice versa, causing rotative motion of the guide pins 56 and 58 in their track 92, causes rotation of the control rods 44 and 46 and a side ways displacement of the tie rod 140. The sealing arrangement against the gaskets remains the same as discussed above; and the principal difference is the direct driving conection of the cams 136 and 138 and their respective control rods 44 and 46, to the tie rod 140 at each end thereof.

FIG. 9 shows yet a further embodiment of the tie means in the upper portion of the moveable panel. Again, only the relevant members have been indicated, for ease of reference, and like elements retain the same designation as in the discussion above with respect to FIGS. 1 through 8.

The principal differences between the embodiment of FIG. 9 and the embodiment of FIGS. 2 and 6 are that the tie means between the control rods is no longer a tie rod but a cable. Here, a pair of spools 146 and 148 is provided, having a cable 150 and a turn buckle 152. Each of the spools 146 and 148 has a centrally disposed opening through it, of a suitable shape and size as to accommodate the respective stems 74 and 76 of the cam elements 48 and 52. When the stems 74 and 76 are inserted through the openings in the spools 146 and 148 and into the respective control rods 44 and 46, it will be seen that the spools 146 and 148 are adapted for rotation with the respective control rods 44 and 46 and cam elements 48 and 52. The cable 150 is passed two or three times around each of the spools 146 and 148, and the ends of the cable are adapted for connection by threaded elements 154 and 156 into the turn buckle 152. So as to preclude any slippage of the cable 150 about either spool 146 or 148, notwithstanding the several wraps of cable around the spool, the cable may be further fixed in place by such as a set screw 158 or 160; and either set screw 158 or 160 may be used without the necesity of both set screws being used.

Rotation of either control rod 44 or 46 will cause tension in one or the other of the bights of cable 150 passed between spools 146 and 148, and since the cable cannot slip on the other spool, similar rotation of that other spool and therefore of the other control rod and cam element about its respective guide member, is thereby assured. Assembly of this embodiment is easier and less expensive than either of the other two embodiments, and for general household purposes it provides an economical and positive acting moveable panel arrangement.

FIG. 10 shows an alternative bottom rail arrangement for the structure according to the present invention, which is particularly adapted for use when the structure is assembled as a patio door. It is desireable, in many instances, to preclude deep indentations where dust or dirt may collect; and at the same time, it may be desireable when the sliding panel unit is very heavy to invert the track and slider co-operating members so as to assure more positive connection between them in view of the weight of the sliding panel, and so as to be aided thereby. Accordingly, in the embodiment shown in FIG. 10, the interior and exterior extrusions may have cross-sections more as shown in that Figure at **916*i* and 916*e*, respectively, with an identical thermal break member 16*t* and flexible gasket member 128. The principal difference is that the track 994 protrudes upwardly, and that the underside of the sliding member which will co-operate with it has a corresponding indent. Obviously, an assembly having a lower rail of the embodiment of FIG. 10 would be such that horizontal displacement of the moveable panel inwardly or outwardly with respect to the frame, would be less likely, because of the interaction between the track 994** and its co-operating slider and guide members, as discussed above.

The door or window structure according to the present invention, overcomes a number of problems of the previous structures, particularly sliding patio doors. Specifically, the following problems are overcome:

1. There is no requirement for a polypropylene pile weatherstripping on the mullion, causing drag on the siding panel, and giving rise to poor air infiltation and exfiltration characteristics. In addition, the polypropylene pile may permit water leakage and becomes brittle and matted with age.

2. Installation requirements as set down by various governmental authorities require that both panels must be removeable. In order to permit that, the rail at the top and bottom of the mullion has had to be machined, thereby resulting in a gap which cannot be adequately plugged. The structure of the present invention overcomes that difficulty by the essential independence of the panels from each other. It also permits overlapping of the weatherstripping at the corners, for superior sealing qualities, compared with prior devices.

3. It has been difficult to provide an adequate thermal break because of the fact that the two panels of the prior structures are offset from each other.

From the above discussion, it is clear that the structure of the present invention provides a substantially air tight door or window structure where there are two panels, one fixed and one moveable, where considerable energy savings may be effected because of the sealing arrangement, and where easy and smooth operation of the moveable panel from a closed to an open position may also be effected.

Thus, the structure of the present invention permits energy savings in respect of heat loss because of air infiltration or exfiltration, and better thermal performance, particularly as compared to the usual sliding patio door structures, and the prior art structures referred to above.

The structure of the present invention overcomes the difficulties and problems enumerated above, and provides the following advantages:

1. Two rows of gasket material or weather stripping, flexible and compressible, are presented, having easy visual inspection and replacement or correction, and being unhindered by hardware required for closing or opening the moveable panel, and being unaffected by gusting winds or inclement weather on the exterior side of the structure and by billowing drapes or curtains on the interior side of the structure.

2. The moving panel is supported at the bottom and is secured in place at its four corners, such that it may be easily moved inwardly and outwardly, and sideways.

3. All four corners of the moveable panel are rigidly connected one to the other, through the control rod and tie rod arrangements, and all four corners of the moveable panel are therefore adapted for rotatable motion about the guide members co-operating with their respective tracks, so that the panel may be moved without distortion and so that the four corners of the panel remain in alignment at all times.

4. Pressure against the panel anywhere will result in forward or rearward movement, because of the alignment and rigid connection of the corners. Therefore, the panel may be opened or closed by pressure exerted against the handle which also serves to lock the panel in place when in its closed position.

5. Sideways motion of the moveable panel without drag or interference with the fixed panel or the mullion between them, is assured. Further, excessive outward movement of the panel may be precluded, and in any event is determined as a function of the dimensions of the cam members, so that the structure is adaptable for both large and small door and/or window installations.

Other specific arrangements of the operating components and other embodiments of specific components of the door or window structure according to the present invention, having regard to the availability of extruded sections, the size of the unit, and its exposure to extremes of weather, may be effected and accommodated, without departing from the spirit and scope of the appended claims.

We claim:

1. A door or window structure for door or window openings in the exterior walls of buildings, having an outer frame, and first and second panels of approximately equal size to each other, said first panel being substantially fixed in place and said second panel being moveable from a first, closed, position to a second, fully open, position; such that when said second panel is in said first position it is substantially co-planar with said first panel, and when said second panel is in said second position it is substantially co-extensive within said outer frame with said first panel, and on the interior side of said structure;

said second panel having a sash frame, and having within said sash frame and at each side thereof a substantially rigid control rod, each said control rod being rotatably mounted within said sash frame and securely connected at its top and bottom ends with a cam member, each of said cam members having a guide member secured thereto for engagement with a co-operating guide track, each said guide member being rotatable with respect to its co-operating guide track;

and a fixed tie means between said control rods so that rotation of one of said control rods causes an equal rotation in the same direction of rotation of the other of said control rods;

said outer frame for said structure having an opening, said opening being of lesser size than said second panel and being at the exterior side thereof when said second panel is in said first position;

a first compressible gasket surrounding said opening at the interior side thereof, said first gasket being placed so as to contact a first co-operating portion of the exterior surface of said second panel, such that when said second panel is in said first position, said first gasket is at least partially compressed;

and a second flexible gasket within said outer frame at the interior side thereof, said second gasket being placed so as to contact a second co-operating portion of the exterior surface of said second panel, such that when said second panel is in said first position, said second gasket is flexed, and a pocket is formed within said outer frame between said first and second gaskets, substantially around the periphery of the exterior surface of said second panel.

2. The structure of claim 1, where said fixed tie means comprises a tie rod.

3. The structure of claim 1, where said fixed tie means comprises a cable passed around a pair of spools, each fixed to one of said control rods; said cable being fixed to at least one of said spools.

4. The structure of claim 1, where said outer frame comprises inner and outer frame members, with a thermal break member mounted between them, and where said second gasket is secured to portions of said thermal break member in the areas surrounding said opening.

5. The structure of claim 1, where said pocket formed within said outer frame between said first and second gaskets, serves to equalize air pressure between the interior and exterior sides of said structure.

6. The structure of claim 1, 2 or 3, where said outer frame comprises inner and outer frame members, with a thermal break member mounted between them.

7. The structure of claim 1, 2 or 3, where said outer frame comprises inner and outer frame members, with a thermal break member mounted between them, where said inner and outer frame members are formed of extruded aluminum, and said thermal break and said first and second gasket members are formed of extruded plastics material.

8. The structure of claim 1, 2 or 3, where said outer frame comprises inner and outer frame members, with a thermal break member mounted between them where said inner and outer frame members are formed of extruded aluminum, and said thermal break and said first and second gasket members are formed of extruded plastics material; where said thermal break is formed of extruded vinyl, and said first and second gasket members are formed of one of the group consisting of extruded vinyl and extruded neoprene.

9. The structure of claim 2, where said cam members at the upper ends of said control rods each co-operate with a gear member, and said gear members each co-operate with a rack member, one at each end of said tie rod, so as to form a rack and pinion driving connection of said cams and their respective control rods to said tie rod at each end thereof.

10. The structure of claim 2, where said cam members at the upper ends of said control rods are rotatably mounted to the respective ends of said tie rod, so as to form a direct driving connection of said cams and their respective control rods to said tie rod at each end thereof.

* * * * *